US005738546A

United States Patent [19]

Burroughs et al.

[11] Patent Number: 5,738,546

[45] Date of Patent: Apr. 14, 1998

[54] PRINTED CIRCUIT BOARD MOUNTED JACK

[75] Inventors: Dennis M. Burroughs, Savage; Edward F. Sansone, Coon Rapids, both of Minn.

[73] Assignee: ADC Telecommunications, Inc., Minneapolis, Minn.

[21] Appl. No.: 347,879

[22] Filed: Dec. 1, 1994

[51] Int. Cl.[6] ..... H01R 17/04

[52] U.S. Cl. ..... 439/620; 439/581; 333/25

[58] Field of Search ..... 333/25, 26; 439/63, 439/581, 620, 76

[56] References Cited

U.S. PATENT DOCUMENTS

| | | | |
|---|---|---|---|
| 4,609,242 | 9/1986 | Kemppainen . | |
| 4,693,537 | 9/1987 | Dinsmore et al. | 439/399 |
| 4,717,896 | 1/1988 | Graham | 333/25 |
| 5,011,415 | 4/1991 | Suzuki et al. | 439/581 |
| 5,133,668 | 7/1992 | Brown, IV | 439/620 |
| 5,240,436 | 8/1993 | Bradley et al. | 439/620 |

FOREIGN PATENT DOCUMENTS

| | | | |
|---|---|---|---|
| 158206 | 7/1986 | Japan | 333/25 |
| 10901 | 1/1987 | Japan | 333/25 |

OTHER PUBLICATIONS

LEMO U.S.A. Inc., Santa Rosa, California dated 1991 entitled "NIM–CAMAC and NIMAX", pp. 9 and 10 show products EPA, EPL and EPS for mounting on a printed circuit board.

Publication of Kings Electronics Company, Inc., Tuckahoe, Catalog 500–89 entitled "RF Coaxial Connectors", p. 119 in Figs. 12 and 13 shows printed circuit board mounted jacks.

*Primary Examiner*—Gary F. Paumen

*Attorney, Agent, or Firm*—Merchant, Gould, Smith, Edell, Welter & Schmidt

[57] ABSTRACT

A printed circuit board mounted jack includes an electrically conductive housing containing a dielectric support. A center pin is contained within the dielectric support. A plurality of terminating leads extend from the dielectric support. A torroid magnet is contained on the dielectric support and connected to the terminating pins for receiving a coaxial signal and converting the coaxial signal to a twisted pair signal.

5 Claims, 15 Drawing Sheets

PRINTED CIRCUIT BOARD MOUNTED JACK

BACKGROUND OF THE INVENTION

1. Field of the Invention

This invention pertains to a jack for mounting directly to a printed circuit board. More particularly, this invention pertains to such a jack for receiving a plug connected to a coax cable.

2. Description of the Prior Art

Jacks for receiving coax plugs are well known. Such jacks have generally cylindrical ports surrounding a center conductor. The center conductor is positioned to receive a central pin of a jack plug inserted within the port.

It is desireable to provide a coax jack which can be mounted directly to a printed circuit board. Examples of jacks which can be mounted to a printed circuit board are found in commonly assigned U.S. Pat. Nos. 4,609,242. Also, examples are shown as products EPL and EPS and EPA found on pages 9 and 10 of a publication entitled, "NIM-CAMAC COAXIAL CONNECTORS and MINAX COAXIAL CONNECTORS" of LEMO U.S.A., Inc., P.O. Box 11488, 335 Tesconi Circle, Santa Rosa, Calif. 95406, published 1991. Similarly, such products are shown on FIGS. 12 and 13 of page 119 of the publication of Kings Electronics Co., Inc., catalog 500-89 and entitled "RF COAXIAL CONNECTORS".

It is an object of the present invention to provide a coax jack which can be mounted on a printed circuit board. It is a further object of the present invention to provide such a jack which can receive a coaxial signal and convert the coaxial signal to a twisted pair signal.

SUMMARY OF INVENTION

According to a preferred embodiment of the present invention, a jack is provided for mounting on a printed circuit board and for receiving a coaxial plug. The jack includes an electrically conductive housing having an interior. A port is provided on the housing and sized to receive a jack plug. A center conductor is carried within the housing with a pin receiving end disposed to receive a pin of a jack plug inserted within the port. A dielectric support holds the pin in alignment within the housing. In a preferred embodiment, the jack includes a torroid magnet for receiving a signal from the center conductor and changing the signal to a twisted pair signal.

DESCRIPTION OF THE PREFERRED EMBODIMENT

Figure 1:
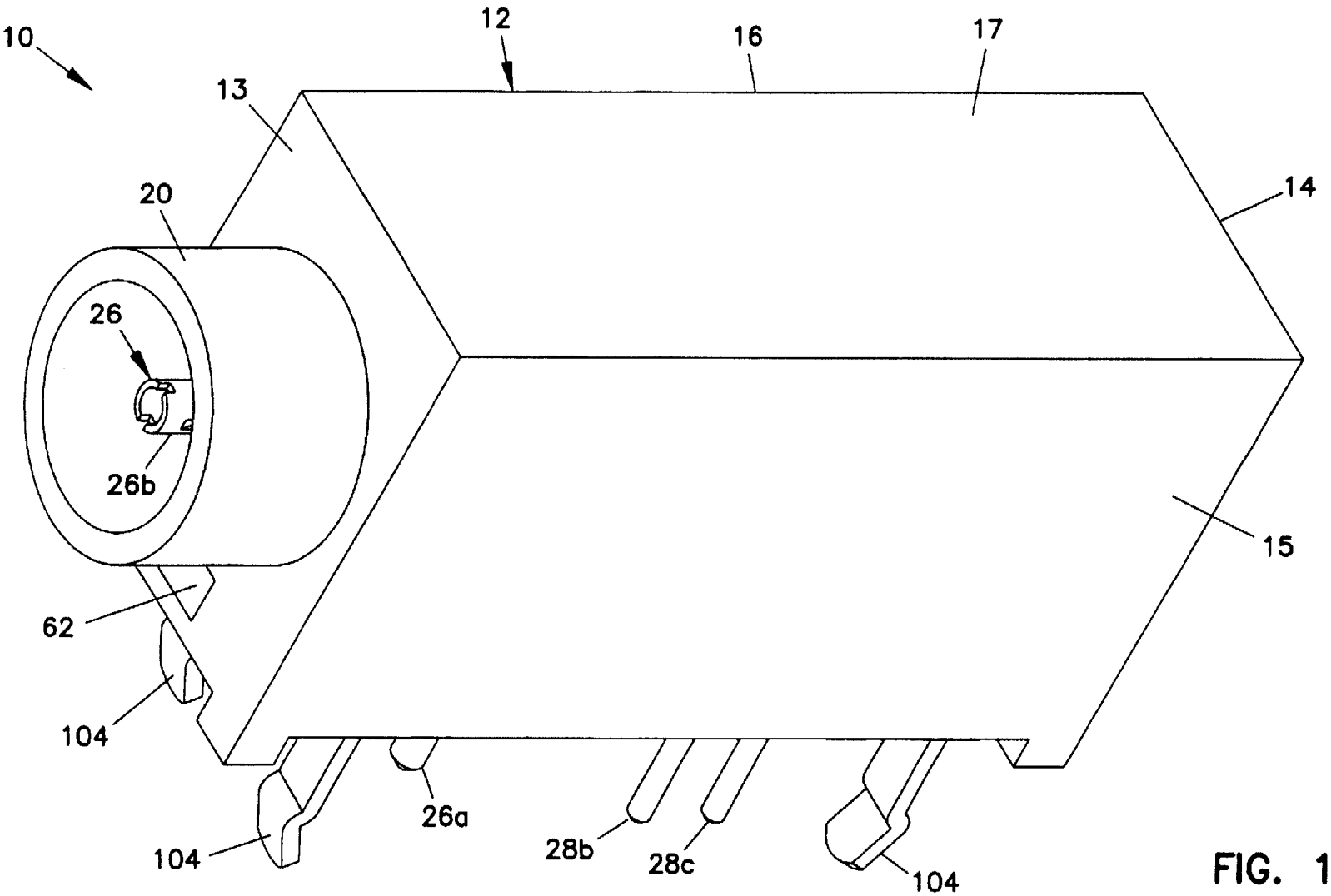
FIG. 1 is a front, right side and top perspective view of a jack according to the present invention.
Figure 2:
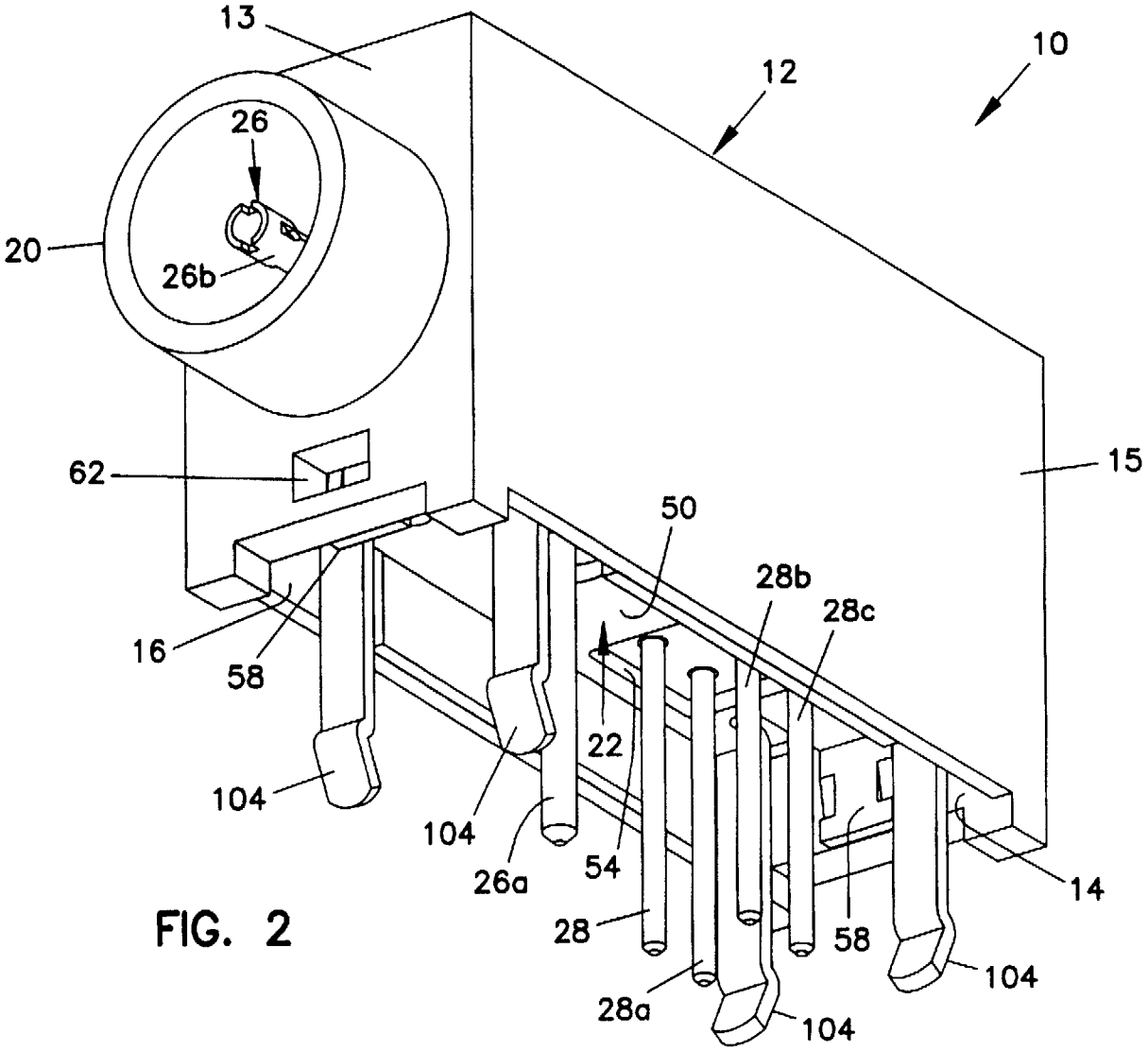
FIG. 2 is a front, right side and bottom perspective view of the jack of FIG. 1.

Referring now to the several drawing figures in which identical elements are numbered identically throughout, a jack 10 according to the present invention will now be described.

The jack 10 includes a die-cast electrically conductive housing 12 which is generally box-shaped in configuration. The housing 12 includes a front wall 13, a rear wall 14, side walls 15, 16 and top wall 17 all cooperating to define a housing interior 18 exposed through the bottom of the jack 10.

The front wall 13 is provided with an integrally formed, electrically conductive cylindrical port 20 which is in communication with the interior 18 of the jack housing 12. The port 20 is sized to receive a plug (not shown) connected to a coaxial cable (not shown). As is common, such plugs have an electrically grounded outer body which, upon insertion into port 20, is in electrical contact with port 20. Furthermore, such plugs have a centrally and axially positioned center pin.

The jack 10 further includes a retaining clip 22, dielectric support 24 and a center conductor 26. In the embodiments of FIG. 1 through 6, the jack 10 further includes four terminating leads 28, **28*a*, 28*b*, and 28*c*. A torroid magnet 30 is provided with windings (shown only in FIG. 14 and schematically in FIG. 15**) for completion of a circuit as will be described.

Dielectric support 24 includes a flat base 34 and a pin support portion 36. The pin support portion 36 has a central bore 38 formed therethrough sized to receive a first leg **26*a* of center conductor 26. A front wall 40 of the pin support portion 36 has a cutout 42 sized to receive a second leg 26*b* of conductor 26 with leg 26*b* nested within cutout 42**.

Figure 3:
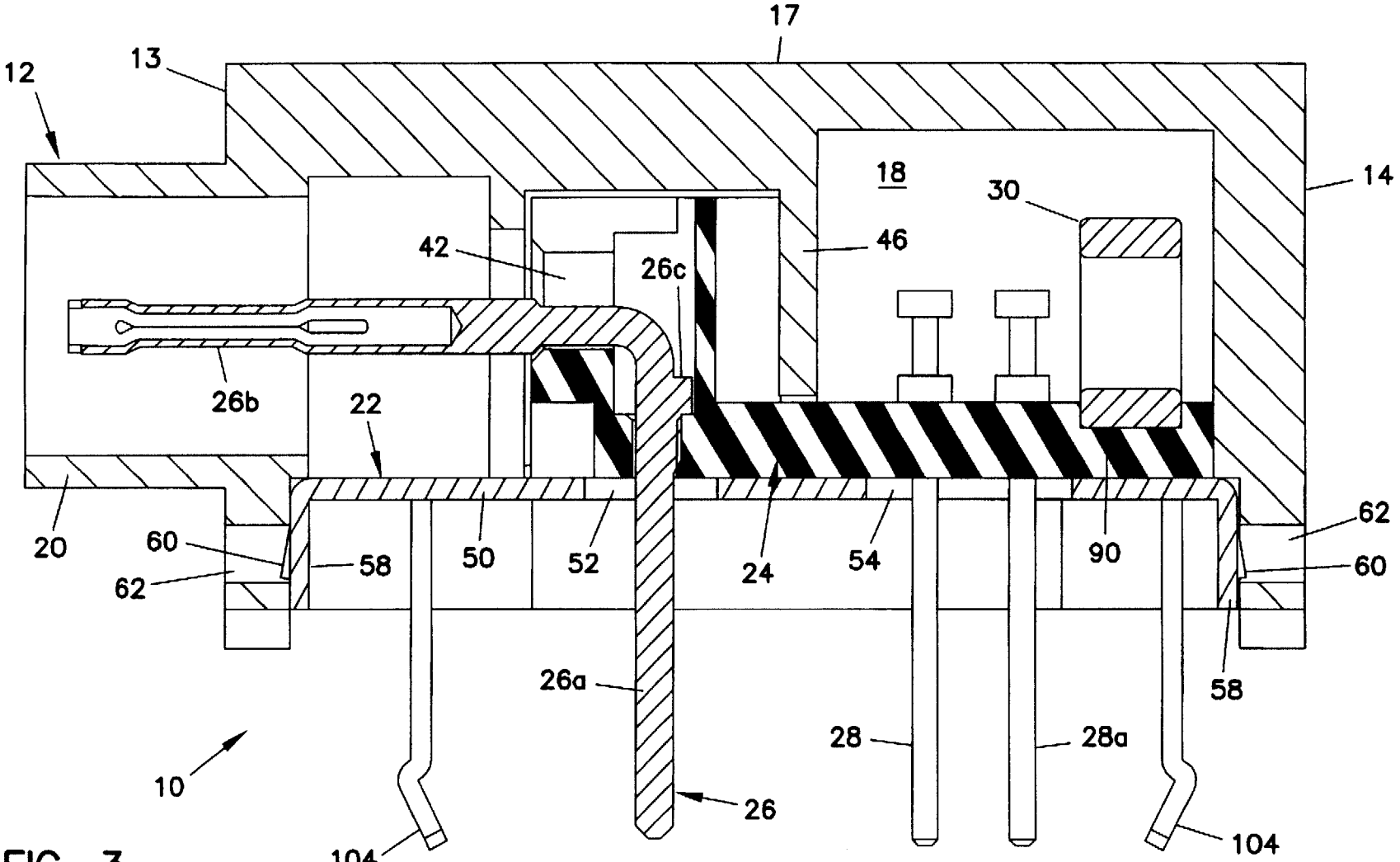
FIG. 3 is a side sectional view of the jack of FIG. 1.
Figure 4:
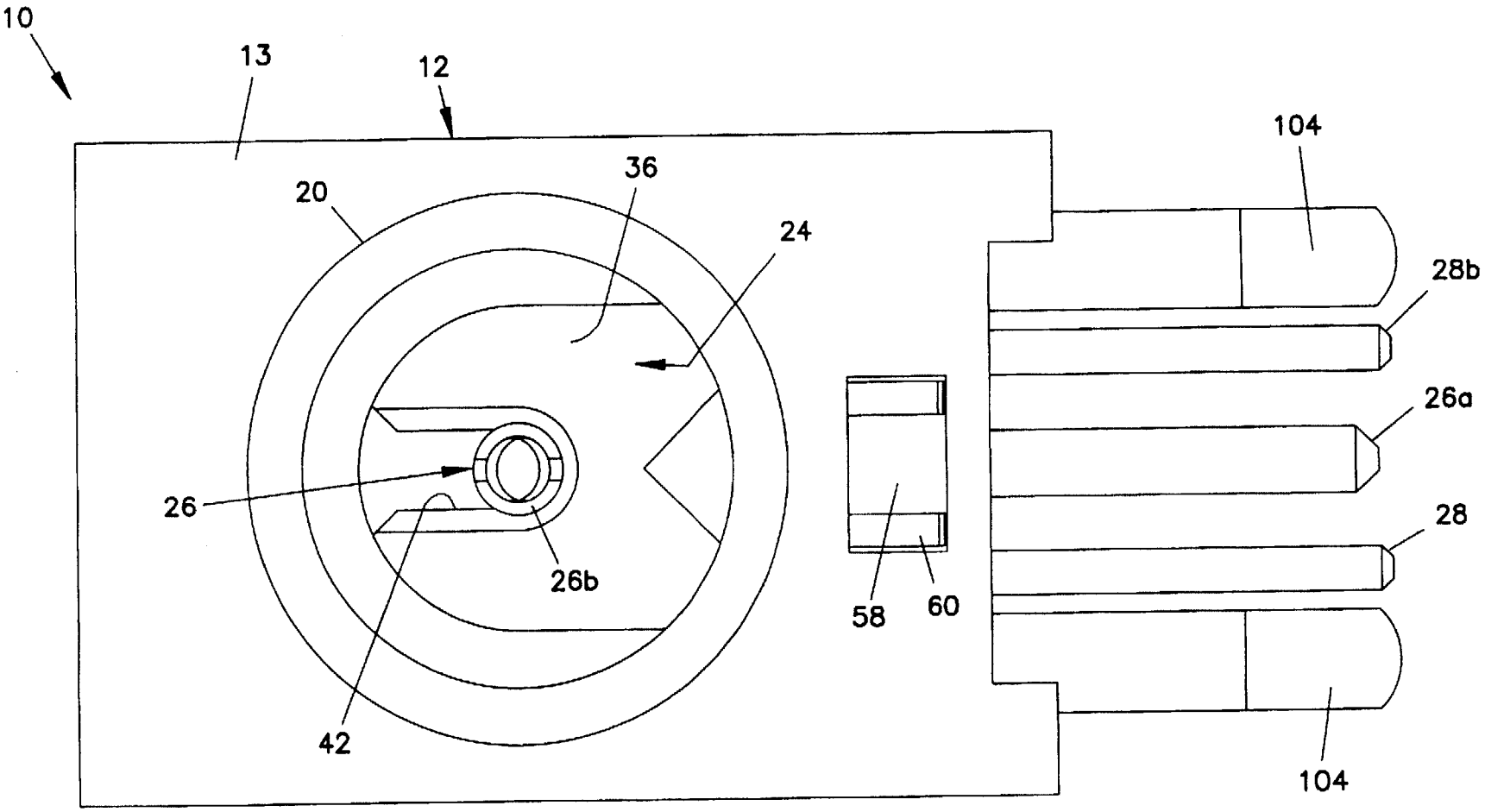
FIG. 4 is a front elevation view of the jack of FIG. 1.
Figure 5:
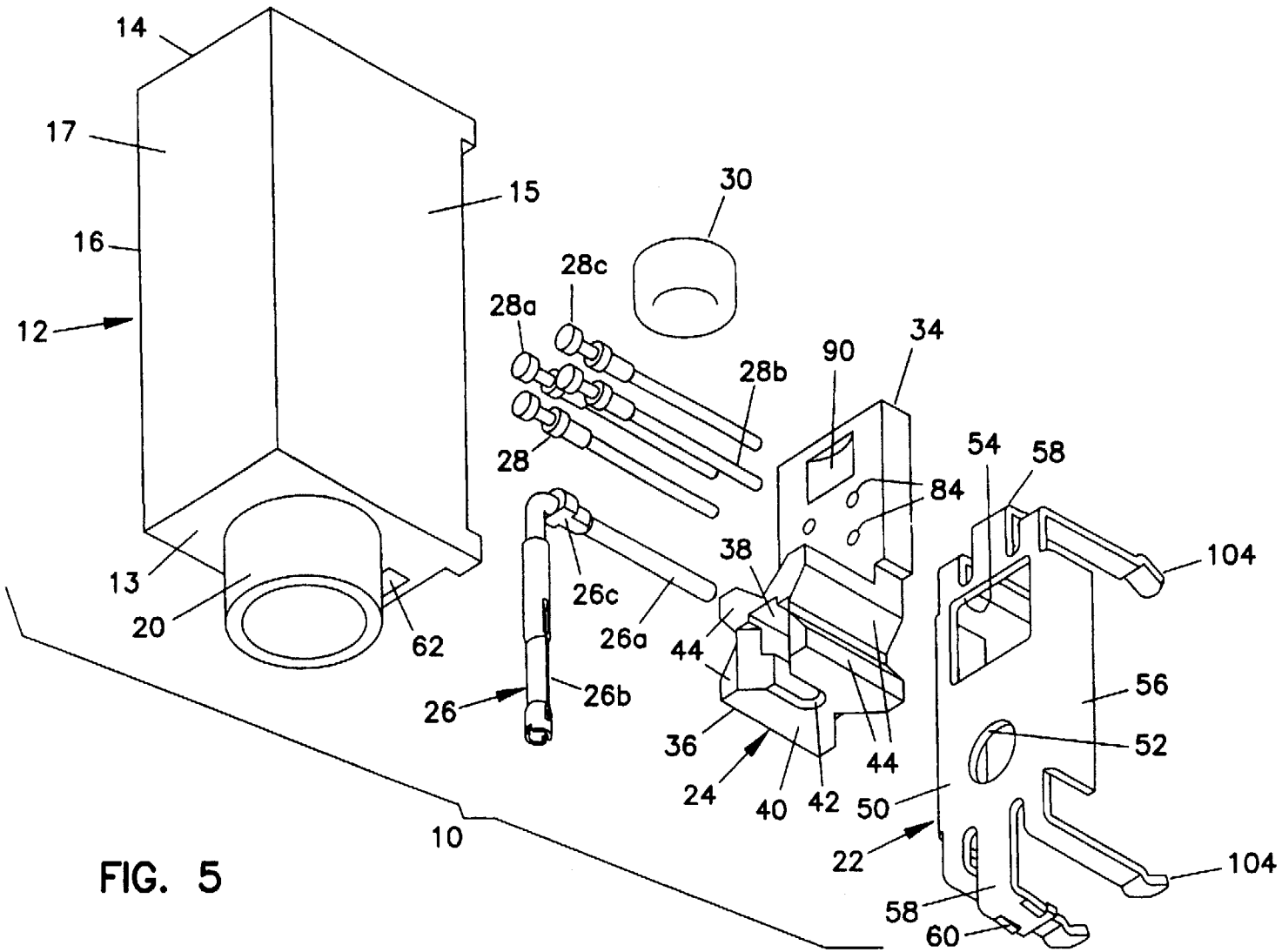
FIG. 5 is a front, right side and top perspective view of the jack of FIG. 1 with the various elements of the jack shown exploded format.
Figure 6:
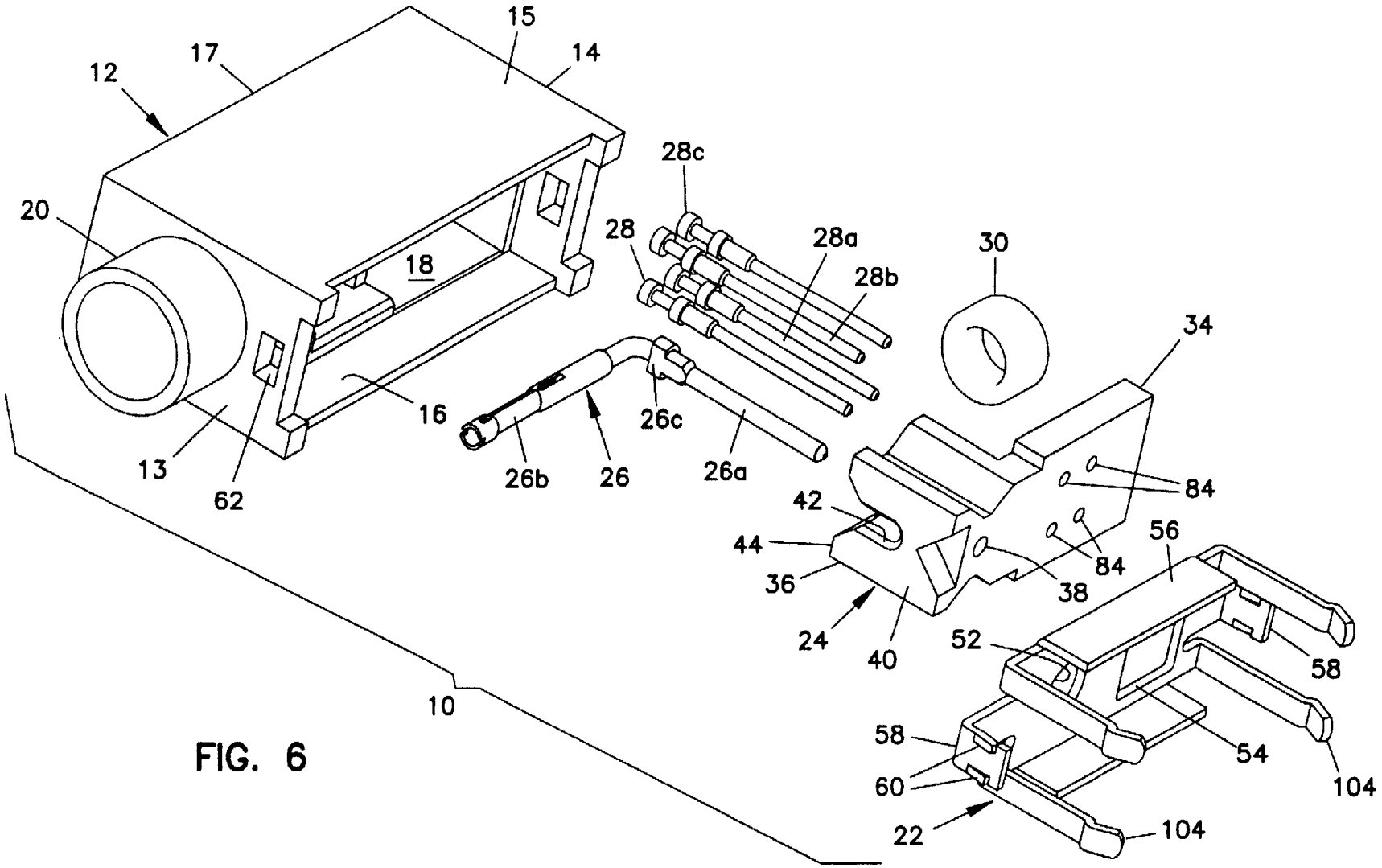
FIG. 6 is a front, right side and bottom perspective view of the jack of FIG. 1 with internal elements shown in exploded format.
Figure 9:
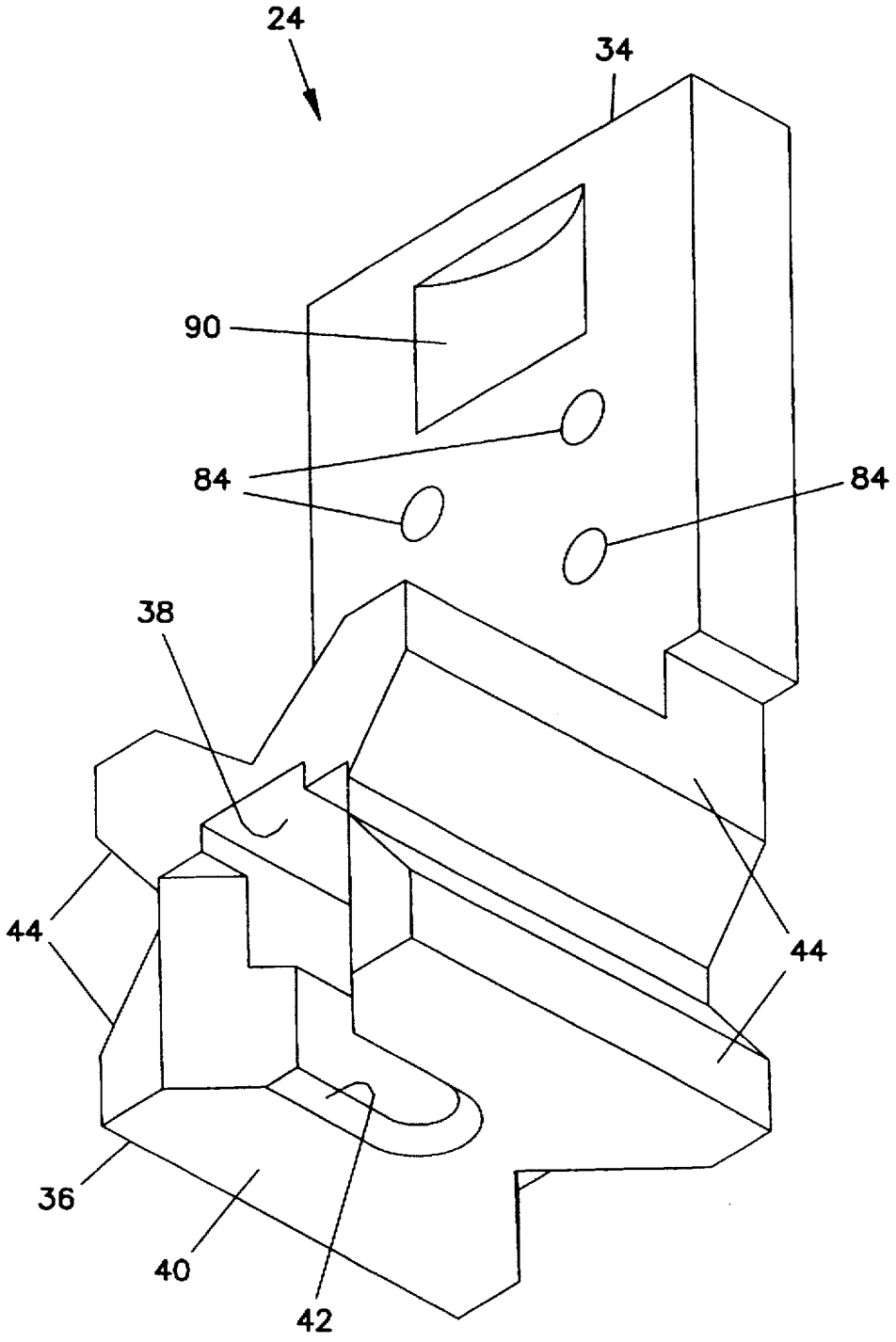
FIG. 9 is a front, top and right side perspective view of a dielectric support for the jack of FIG. 1.
Figure 10:
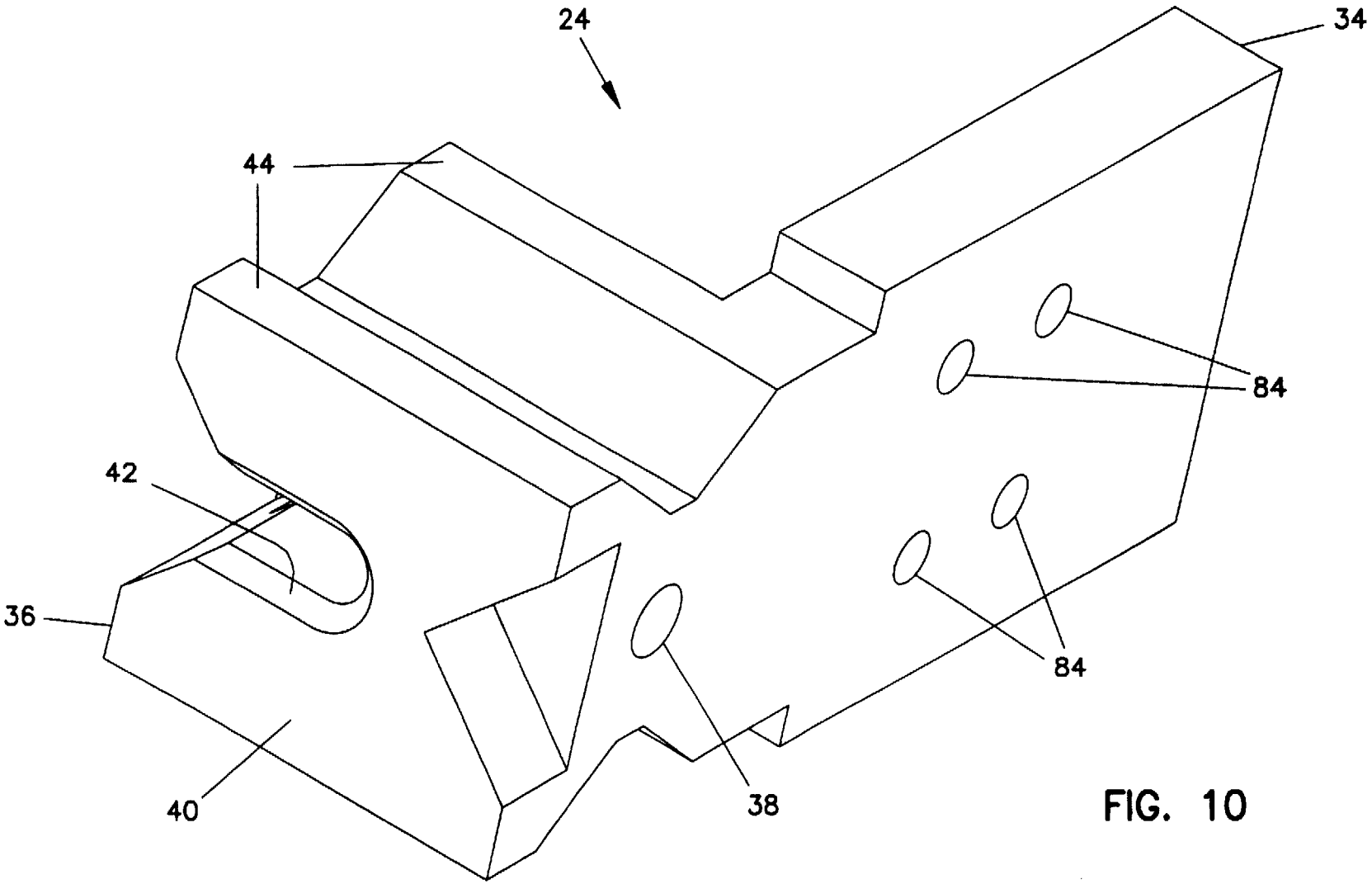
FIG. 10 is a front, right side and bottom perspective view of the support of FIG. 9.
Figure 11:
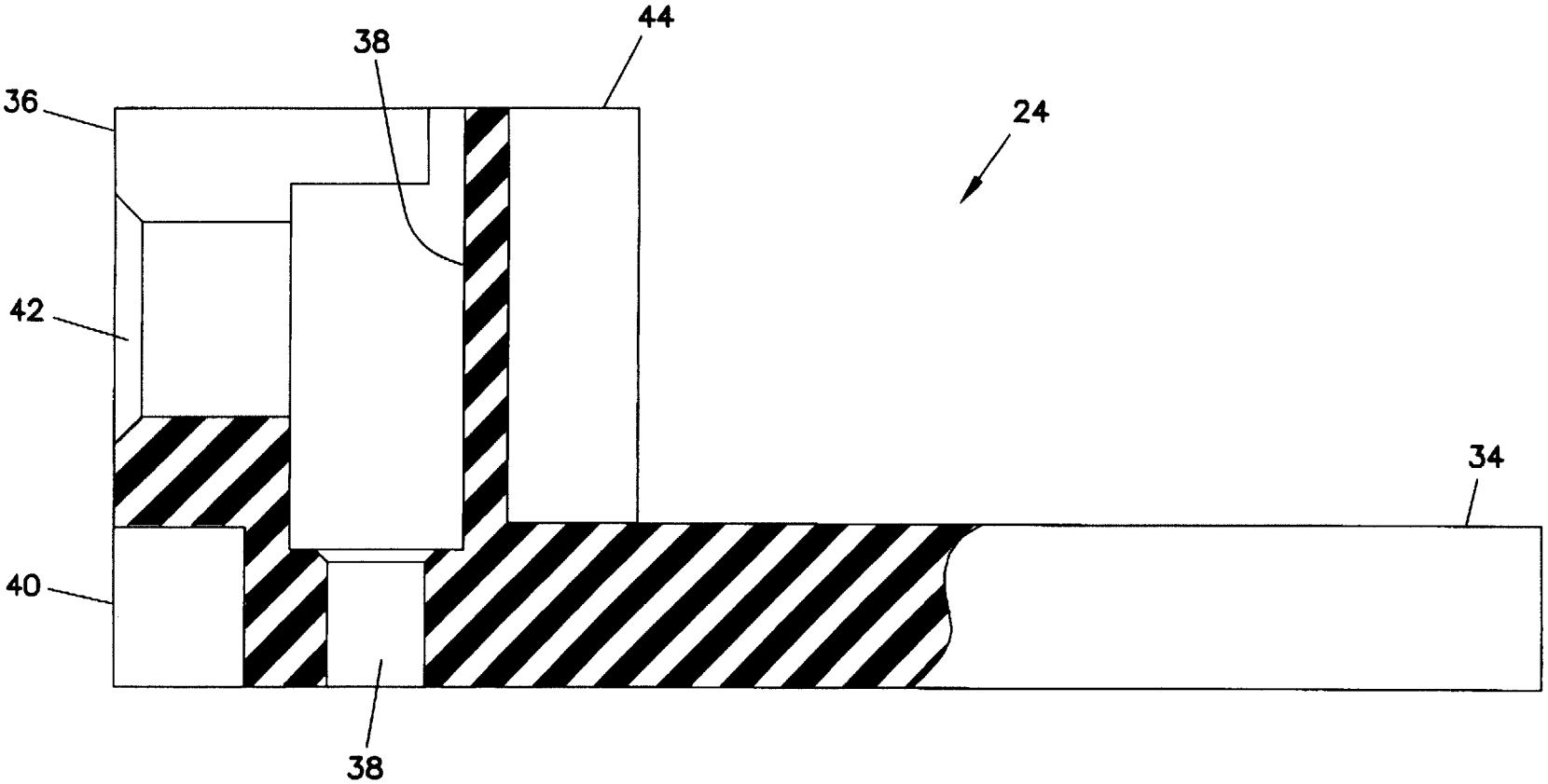
FIG. 11 is a side sectional view of the support of FIG. 9.
Figure 12:
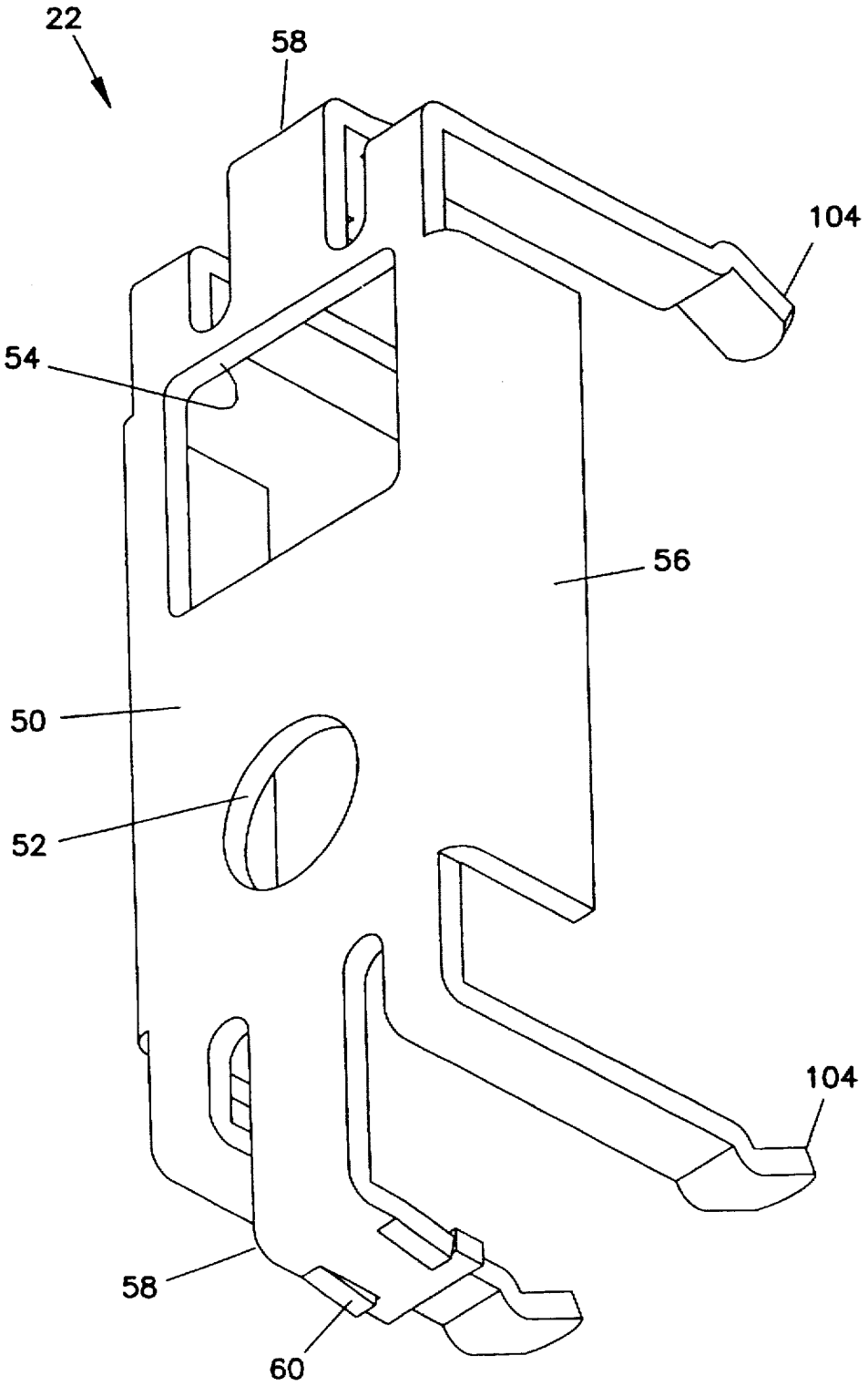
FIG. 12 is a front, right side and top perspective view of a retaining clip for the jack of FIG. 1.

Extending radially from bore 38 are a plurality of spacers 44 (see FIG. 9). The spacers 44 are sized to position the dielectric support 24 and to provide the appropriate geometry for impedance matching purposes. As shown in FIG. 3, the housing 12 includes internal walls 46 which act as stops to correctly align the positioning of the support 24 within the housing 12.

The center pin includes a stop **26*c* for positioning and locking the center conductor 26 within the support 24. Accordingly, with the support 24 disposed within the housing 12 as shown in FIG. 3, the leg 26*b* is axially positioned within port 20**.

Leg **26*b* is a hollow tubular member having an axially extending slit for receiving a pin (not shown) of a jack plug inserted within port 20. Legs 26*a* and 26*b* are disposed at 90 degree angles relative to one another such that leg 26*a* extends completely through the dielectric support and is sized to extend out of the housing 12**.

To retain the dielectric support 24 in fixed position within the housing 12, the retaining clip 22 is provided. Clip 22 is formed of stamp electrically conductive metal and has a flat upper base 50 with a first cutout 52 and a second cutout 54. First cutout 52 is sized to freely pass leg 26*a* without electrical contact with the leg 26*a*. Second cut-out 54 is sized to oppose the flat base 34 of support 24 for purposes that will become apparent.

Extending downwardly from opposite sides of base 50 are sidewalls 56 which are sized to be press fit between side walls 15,16 of housing 12 upon insertion of the clip 22 within the housing 12. Positioned on both the front and back of the base 50 are locking clips 58 provided with locking tabs 60. The locking clips 58 and locking tab 60 are sized to snap fit into slots 62 formed in the front and rear walls 13,14 of housing 12 as best shown in FIG. 3. The press fit nature of the side walls 56 and the locking of tabs 60 securely positions the clip 22 within the housing 12. Accordingly, the dielectric support 24 and center conductor 26 are securely positioned in correct positioning within the housing 12 with leg portion 26*b* axially aligned within port 20.

Figure 13:
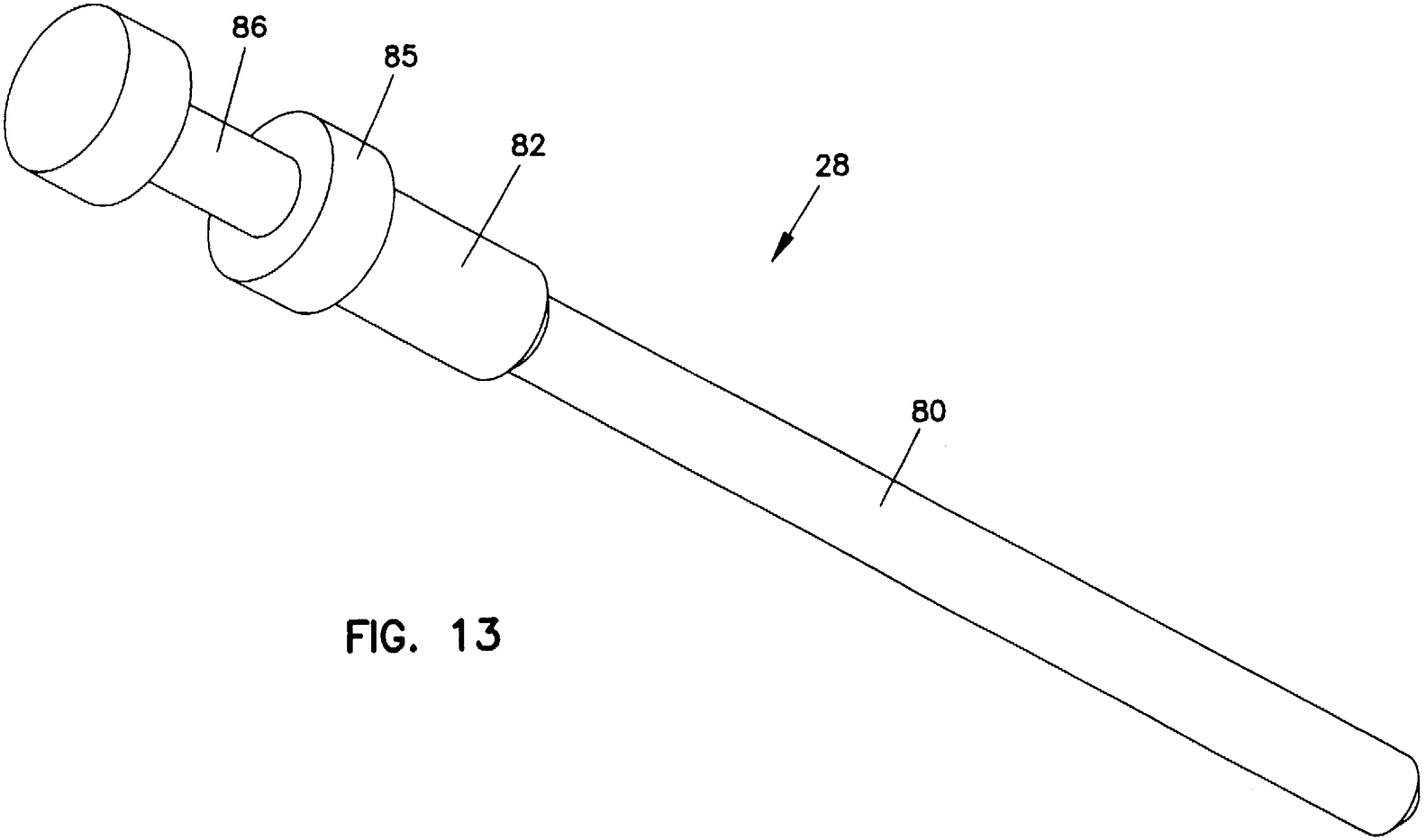
FIG. 13 is a perspective view of a terminating lead for the jack of FIG. 1.

Each of terminating leads, 28,28*a*–28*c*, is identical and a description of terminating lead 28 in FIG. 13 will suffice as a description of all leads. Terminating lead 28 as shown in FIG. 13 is an electrically conductive pin having an extending pin end 80. An enlarged diameter portion 82 is provided to be received within holes 84 formed through base 34 of dielectric support 24. The enlarged diameter portions 82 are sized to be press fit and snugly received within the holes 84. A stop ring 85 limits the degree of insertion of the pin into holes 84. A terminating end 86 is provided for terminating a wire onto each of the pins 28,28*a*–*c*. As shown, hole 54 in clip 22, is sized to freely pass each of the pin ends 80 through the bottom of the housing without making electrical contact with any of the pin ends.

Figure 14:
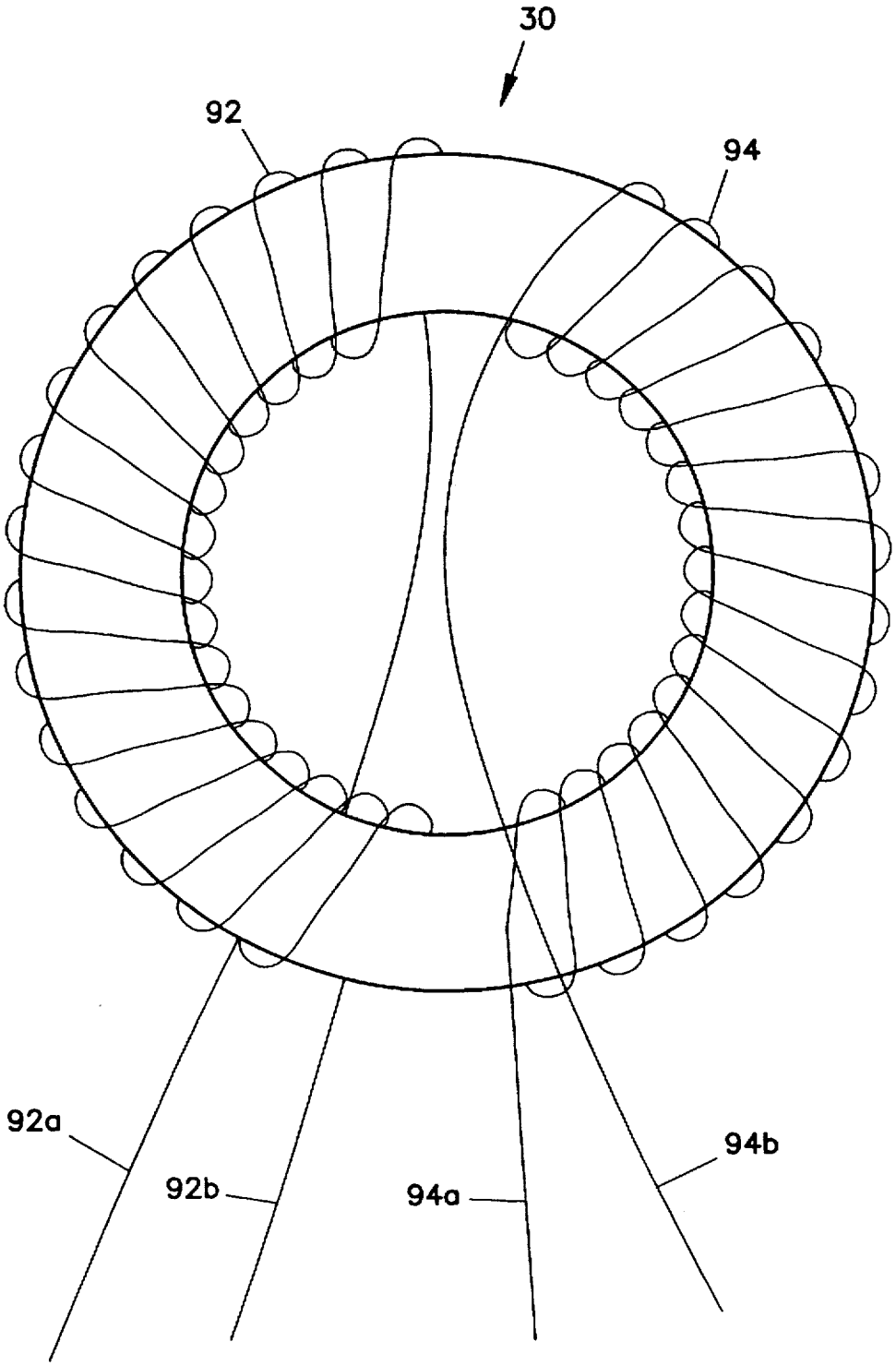
FIG. 14 is a front elevation view of a torroid magnet of the jack of FIG. 1 shown with leads wound on the magnet.

The base 34 is further provided with a pocket 90 sized to receive the torroid magnet 30. With the structure thus described, two wires 92,94 are wound onto the torroid magnet 30 as shown in FIG. 14. The wires 92,94 terminate at ends 92*a*,92*b* and 94*a*,94*b*. Wire 92*a* is terminated on pin 28. Wire end 92*b* iserminated on pin 28*b*, wire end 94*a* is terminated on pin 28*a* and wire end 94*b* is terminated on pin 28*c* (see FIG. 15).

Figure 16:
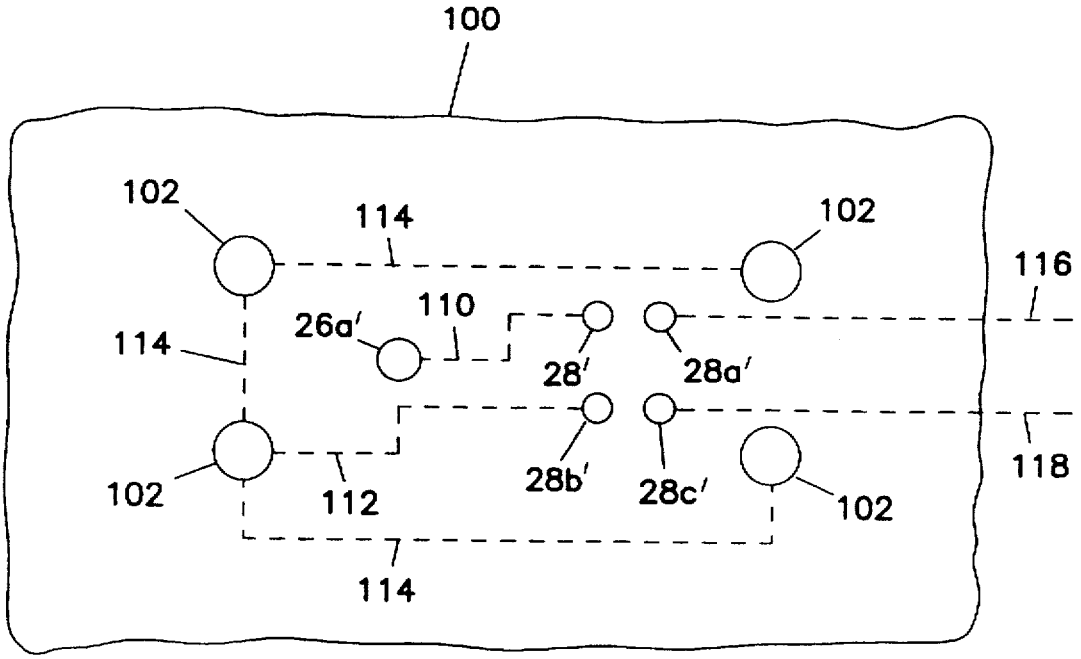
FIG. 16 is a top plan view of a whole pattern for a printed circuit board for receiving the jack of FIG. 1.

As mentioned, it is the intent of the present invention for utilizing the jack 10 on a printed circuit board. FIG. 16 shows a hole pattern for a printed circuit board 100. The hole pattern includes a plurality of enlarged holes 102 sized to receive the mounting tabs 104 of clip 22. A hole 26*a*' is provided to receive leg 26*a* when the jack 10 is mounted on the printed circuit board 100 with tabs 104 received within holes 102. Similarly, holes 28',28*a*',28*b*' and 28*c*' are provided for receiving pins 28,28*a*,28*b* and 28*c*, respectively, when the jack 10 is mounted on the printed circuit board 100 with the clips 104 received within holes 102. On the printed circuit board 100, a plurality of circuit paths (shown in dashed lines) are provided. These include a circuit path 110 connecting hole 26*a*' with hole 28'. Likewise, circuit path 112 connects hole 102 with hole 28*b*'. A grounded circuit path 114 connects hole 102.

Figure 15:
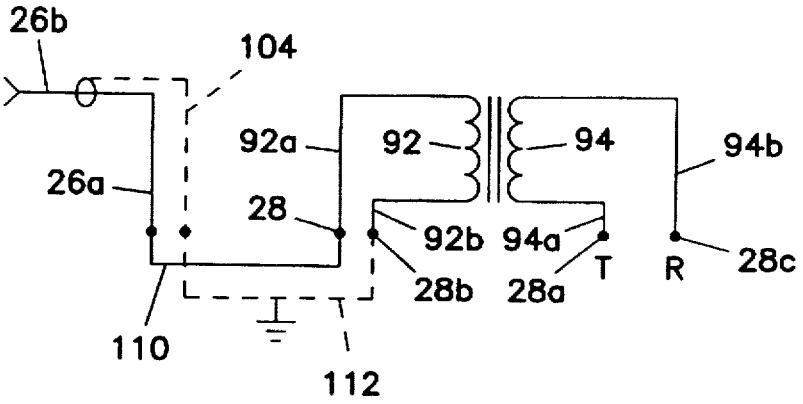
FIG. 15 is a schematic representation of the circuit of the jack of FIG. 1.

Circuit paths 116, 118 are shown connected to holes 28*a*',28*c*'. In FIG. 15, paths 116 and 118 are labeled T and R (representing "Tip" and "Ring" as is conventional in telecommunications terminology). The circuit of the combination of the jack 10 with the circuit paths of printed circuit board 100 is shown in FIG. 16. With the circuit thus described, the jack 10 can receive a jack plug received within port 20. A 75 ohm unbalanced output from the jack plug is carried on the center pin 26. The use of the torroid magnet 30 (also referred to as a balun) permits a 75 ohm to 120 ohm conversion of the coax signal from the center conductor 26 to a twisted pair signal at points T and R.

Figure 7:
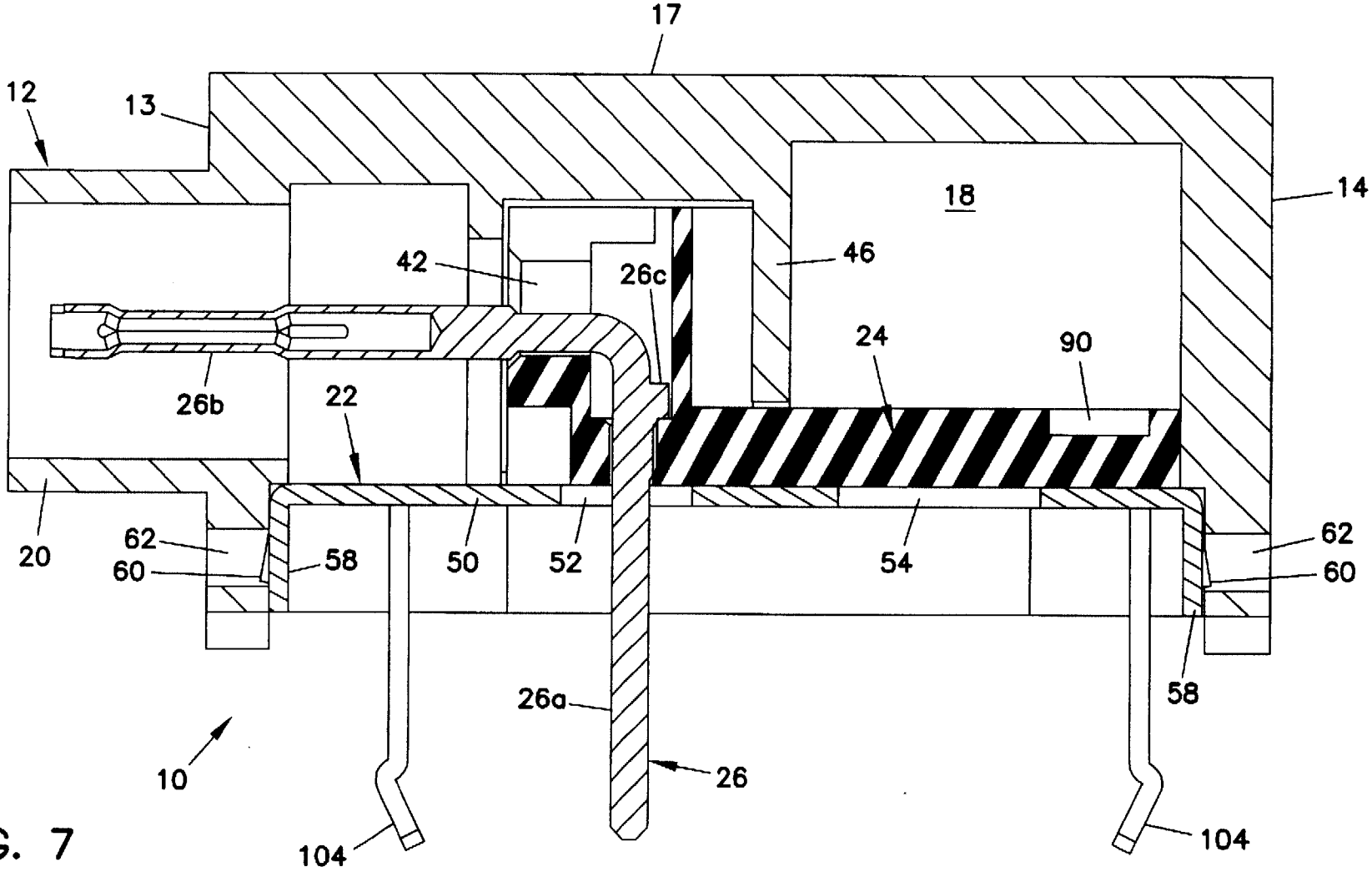
FIG. 7 is a side sectional view of a alternative embodiment of the jack of FIG. 1.
Figure 8:
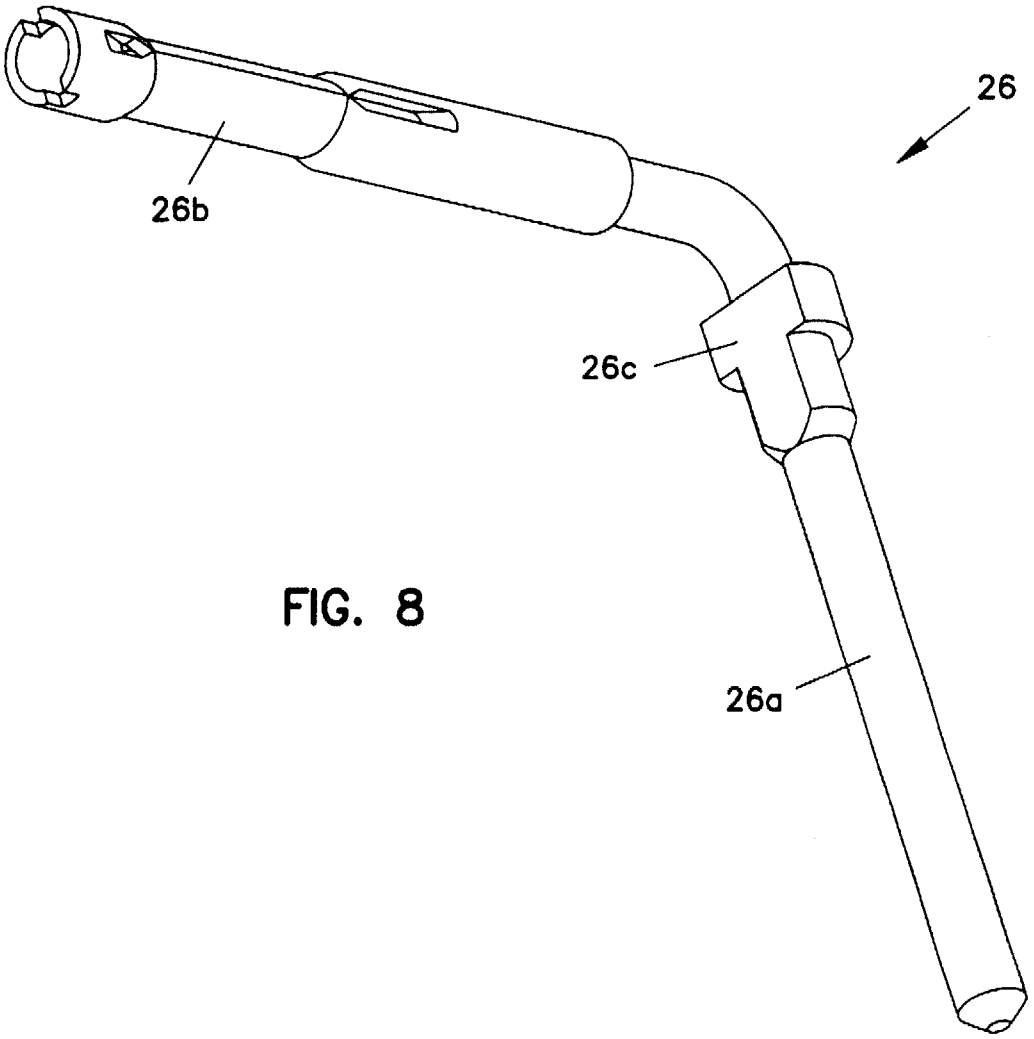
FIG. 8 is a perspective view of a center conductor for the jack of FIG. 1.

In an alternative embodiment of the present invention, the jack 10 can be utilized for carrying a coaxial signal out of the jack on a printed circuit board. In such a usage, a balun 30 and pins 28 are simply eliminated from the construction with all other elements remaining identical. Such a jack is shown in FIG. 7.

With the structure thus described, a printed circuit board jack 10 is provided which can be used for both converting to a twisted pair signal or for use with a coaxial signal on a printed circuit board. The jack 10 is compact, easy to assemble and of low cost manufacture.

Having described the present invention in a preferred embodiment, modifications and equivalents of the disclosed concepts may readily occur to one skilled in the art. However, it is intended that such modifications and equivalents be included within the scope of the claims which are appended hereto.

What is claimed:

1. A coaxial jack for mounting on a printed circuit board, said jack comprising:

an electrically conductive housing having an interior;

a port disposed on said housing and in communication with said interior, said port sized to receive a coaxial jack plug;

a center conductor having a pin receiving end and a lead end;

a dielectric support sized received within said interior and hold said center conductor in spaced relation to said housing with said pin receiving end disposed to receive a center pin of a jack plug inserted within said port, said center conductor further having a lead end within said dielectric support sized to pass said lead end out of said housing;

a retaining clip sized to be secured within said housing in a predetermined position;

said retaining clip, said dielectric support and said housing having a plurality of mutually opposing surfaces for said support to be secured in a predetermined position within said housing when said clip is secured to said housing;

a plurality of terminating pins secured to said dielectric support with said terminating pins extending through said housing;

circuit means contained within said interior including a circuit path connected to said pins for receiving a coaxial signal and converting said coaxial signal to a twisted pair signal.

2. A jack according to claim 2 wherein said plurality of pins and said lead end are disposed in generally parallel spaced-apart alignment extending from a base of said jack.

3. A jack according to claim 1 wherein said lead pin end and said terminating pins extend at a generally 90 degree angle with respect to said pin receiving end of said center conductor.

4. A jack according to claim 1 wherein said clip includes a plurality of snap contacts for engaging aligned surfaces of said housing when said clip is in said predetermined position.

5. A jack according to claim 1 wherein said clip includes a plurality of mounting tabs extending from said clip in a direction generally parallel to said terminating pins.

* * * * *